US012798739B2

(12) United States Patent
Newby et al.

(10) Patent No.: US 12,798,739 B2
(45) Date of Patent: Nov. 17, 2026

(54) WATERCRAFT SYSTEM

(71) Applicant: BAE SYSTEMS plc, London (GB)

(72) Inventors: Simon Phillip Newby, Barrow-in-Furness Cumbria (GB); David Charles Alexander Ritchie, Barrow-in-Furness Cumbria (GB); Lawrence Edward Clabburn, Barrow-in-Furness Cumbria (GB)

(73) Assignee: BAE SYSTEMS PLC, London (GB)

( * ) Notice: Subject to any disclaimer, the term of this patent is extended or adjusted under 35 U.S.C. 154(b) by 400 days.

(21) Appl. No.: 18/563,613

(22) PCT Filed: May 18, 2022

(86) PCT No.: PCT/GB2022/051241
§ 371 (c)(1),
(2) Date: Nov. 22, 2023

(87) PCT Pub. No.: WO2022/254176
PCT Pub. Date: Dec. 8, 2022

(65) Prior Publication Data

US 2024/0217636 A1 Jul. 4, 2024

(30) Foreign Application Priority Data

Jun. 2, 2021 (EP) ..... 21275070
Jun. 2, 2021 (GB) ..... 2107864

(51) Int. Cl.
*B63G 8/00* (2006.01)
*B63G 8/28* (2006.01)

(52) U.S. Cl.
CPC ..... *B63G 8/001* (2013.01); *B63G 8/28* (2013.01)

(58) Field of Classification Search
CPC . B63G 8/001; B63G 8/28; B63G 8/24; B63G 8/41; B63G 8/33
See application file for complete search history.

(56) References Cited

U.S. PATENT DOCUMENTS 1,510,283 A * 9/1924 Lake ..... B63G 8/00 114/321
2,332,549 A 10/1943 Baer
(Continued)

FOREIGN PATENT DOCUMENTS

DE 102004060010 B3 12/2005
WO 2016087090 A1 6/2016
WO 2022254176 A1 12/2022

OTHER PUBLICATIONS

International Search Report and Written Opinion received for PCT/GB2022/051241 Mailed: Jun. 27, 2022. 8 pages.
(Continued)

*Primary Examiner* — Anthony D Wiest
(74) *Attorney, Agent, or Firm* — Arcane Law PLLC

(57) ABSTRACT

A watercraft system (10). The watercraft system (10) comprises a submarine or a submersible configured to be submerged in water. The submarine or submersible have an external hull (12) which defines a hull outer surface (20). There is provided a releasable mounting system (100) for carrying a payload unit (202, 204) external to the hull outer surface (20). The releasable mounting system (100) is operable to release the payload unit (202, 204) from the hull (12). The watercraft system (10) further comprises a payload unit (202, 204) which is neutrally buoyant.

18 Claims, 3 Drawing Sheets

(56) References Cited

U.S. PATENT DOCUMENTS

| | | | | |
|---|---|---|---|---|
| 4,231,311 | A * | 11/1980 | Longerich | B63G 9/02 367/1 |
| 4,306,413 | A | 12/1981 | Middleton | |
| 12,244,352 | B1 * | 3/2025 | Seeley | B63B 35/00 |

OTHER PUBLICATIONS

GB Search Report under Section 17(5) received for GB Application No. 2107864.7, dated Mar. 22, 2022. 3 pages.
Extended European Search Report received for EP Application No. 21275070.7, dated Dec. 7, 2021. 7 pages.

* cited by examiner

WATERCRAFT SYSTEM

FIELD

The present disclosure relates to a watercraft system.

In particular it relates to a watercraft system comprising a submarine or a submersible for carrying a payload unit external to an outer hull of the submarine or submersible.

BACKGROUND

It is known to carry payloads on the external hulls of submarines, for example smaller submersibles or equipment to be deployed by the submarine (for example a test unit to be dropped on the sea bed).

An issue with such systems is that the mass and buoyancy of the payload must be managed by the submersible system. Hence, for example, when the payload is reduced in mass, then its buoyancy may increase, requiring some adjustment to the buoyancy of the submarine system. Likewise, if the payload is suddenly removed from the submarine, this may also require compensation by the submarine buoyancy system. Depending on change in buoyancy the submarine systems may not be able to adequately compensate.

Hence a watercraft system which reduces the impact of a change in mass caused by a reduction in payload mass is highly desirable.

SUMMARY

According to the present disclosure there is provided an apparatus and method as set forth in the appended claims. Other features of the invention will be apparent from the dependent claims, and the description which follows.

Accordingly there may be provided a watercraft system (10). The watercraft system (10) comprises a submarine or submersible configured to be submerged in water. The submarine or submersible has an external hull (12). The hull (12) may have a longitudinal axis (14) which extends between an aft end (16) and a forward end (18). The hull (12) defines a hull outer surface (20). The system comprises a releasable mounting system (100) for carrying a payload unit (202, 204) external to the hull outer surface (20). The releasable mounting system (100) is operable to release the payload unit (202, 204) from the hull (12). The watercraft system (10) further comprises a payload unit (202, 204) which is neutrally buoyant.

The payload unit (202, 204) may be operable to remain neutrally buoyant while coupled to the hull (12).

The payload unit (202, 204) may comprise at least one of: a sensor system; a sonar system; a rechargeable battery system (206); a 'single shot' disposable battery system (206); a watercraft signature altering system; a sea-bed deployable system.

The payload unit (202, 204) may be operable to carry a material which is removable from the payload unit (202, 204) during the operation of the payload unit (202, 204). The payload unit (202, 204) may be operable to receive a mass of water into the payload unit (202, 204) which equals the mass of material removed from the payload unit (202, 204).

The payload unit (202, 204) may comprise at least one of: a fuel tank (210); projectile storage and/or launch system (208); a sea-bed deployable system.

The payload unit (202) may comprise a port side payload unit (202). The releasable mounting system (100) may comprise: a port side unit (110) located on the port side of the hull (12) for carrying and releasing the port side payload unit (202). The port side unit (110) may comprise a port side payload unit mounting apparatus (132). The port side payload unit mounting apparatus (132) may be operable to have a first configuration in which the port side payload unit mounting apparatus (132) is engaged with the port side payload unit (202). The port side payload unit mounting apparatus (132) may be operable to have a second configuration in which the port side payload unit mounting apparatus (132) is disengaged from the port side payload unit (202).

The port side payload unit mounting apparatus (132) may be operable to switch from the first configuration to the second configuration in response to a first command signal.

The payload unit (204) may comprise a starboard side payload unit (204). The releasable mounting system (100) may comprise: a starboard side unit (120) located on the starboard side of the hull (12) for carrying and releasing a starboard side payload unit (204). The starboard side unit (120) may comprise a starboard side payload unit mounting apparatus (134). The starboard side payload unit mounting apparatus (134) may be operable to have a first configuration in which the starboard side payload unit mounting apparatus (134) is engaged with the starboard side payload unit (204). The starboard side payload unit mounting apparatus (134) may be operable to have a second configuration in which the starboard side payload unit mounting apparatus (134) is disengaged from the starboard side payload unit (204).

The starboard side payload unit mounting apparatus (134) may be operable to switch from the first configuration to the second configuration in response to a second command signal.

The first command signal and second command signal may be derived from a common command signal.

The port side payload unit mounting apparatus (132) and the starboard side payload unit mounting apparatus (134) may be independently operable to switch from the first configuration to the second configuration.

The port side payload unit mounting apparatus (132) may comprise a port side explosive release unit (142). In the first configuration the port side explosive release unit (142) may carry the port side payload unit (202). In the second configuration the port side explosive release unit (142) may release the port side payload unit (202) from the hull (12).

The starboard side payload unit mounting apparatus (134) may comprise a starboard side explosive release unit (144). In the first configuration the starboard side explosive release unit (144) may carry the starboard side payload unit (204). In the second configuration the starboard side explosive release unit (144) may release the starboard side payload unit (204) from the hull (12).

There may further be provided a method of operation of a watercraft system (10), wherein the watercraft system (10) comprises a submarine or a submersible configured to be submerged in water, having an external hull (12). The hull (12) may have a longitudinal axis (14) which extends between an aft end (16) and a forward end (18). The hull (12) defines a hull outer surface (20). The watercraft system (10) comprises a releasable mounting system (100) for carrying a payload unit (202, 204) external to the hull outer surface (20); the releasable mounting system (100) operable to release the payload unit (202, 204) from the hull (12). The watercraft system (10) further comprises a payload unit (202, 204). The method is characterised by controlling the payload unit (202, 204) to be neutrally buoyant during operation of the payload unit (202, 204).

The payload unit (202, 204) may be operable to carry a material which is removed from the payload unit (202, 204)

during the operation of the payload unit (202, 204). The method may comprise the step of controlling a flow of water into the payload unit (202, 204) so that the mass of water entering the payload unit equals the mass of material removed from the payload unit (202, 204).

Hence there may be provided watercraft system 10 with an external hull 12 and a releasable mounting system 100 for carrying a payload unit 202, 204 external to the hull outer surface 20. The releasable mounting system 100 is operable to uncouple the payload unit 202, 204 from the hull 12 when required, and to carry the payload for as long as needed. Since the payload unit 202, 204 is neutrally buoyant, the presence or absence of the payload on the hull of the submarine does not impact the buoyancy of the submarine, and hence does not require buoyancy systems of the submarine to compensate for the presence or absence of the payload unit 202, 204.

BRIEF DESCRIPTION OF THE FIGURES

Examples of the present disclosure will now be described with reference to the accompanying drawings, in which.

DETAILED DESCRIPTION

Figure 1:
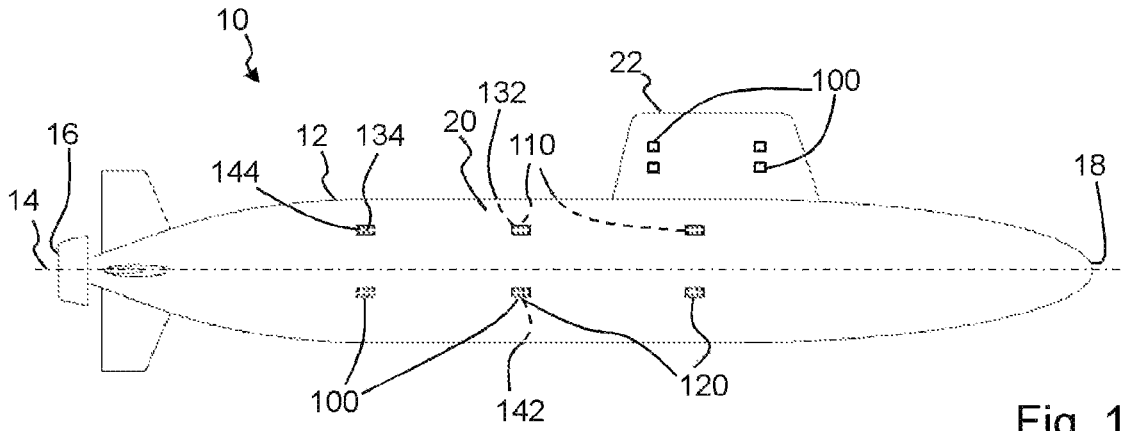
FIG. 1 shows a submarine/submersible of a watercraft system according to the present disclosure.

The watercraft system 10 is illustrated with reference to FIGS. 1 to 5. The watercraft system 10 of the present disclosure may comprises a submarine, for example a submersible configured to be submerged in water. Hence the watercraft system 10 comprises a vessel with a water/air tight sealable hull 12, for example a pressure hull. The hull 12 may have a longitudinal axis 14. Hence the hull 12 defines and/or surrounds a pressure vessel. The watercraft system 10 and/or the hull 12 may extend between an aft end 16 and a forward end 18. As illustrated in the figures, the aft end 16 may be spaced apart from the forward end 18 along the longitudinal axis 14.

The hull 12 defines a hull outer surface 20. As shown in FIG. 1, the system 10 further comprises a releasable mounting system 100 for carrying a payload unit 202, 204 which forms part of the watercraft system 10, shown in FIGS. 2 to 5. The payload unit(s) 202, 204 are carried external to the hull outer surface 20.

The payload unit 202, 204 is configured to be neutrally buoyant. That is to say, the payload unit 202, 204 is configured to be neutrally buoyant in the water in which the submarine is immersed.

Neutral buoyancy occurs when an object's average density is equal to the density of the fluid in which it is immersed, resulting in the buoyant force balancing the force of gravity that would otherwise cause the object to sink or rise. An object that has neutral buoyancy will neither sink nor rise in the supporting fluid.

The releasable mounting system 100 may comprise one or more releasable mounting units. In one example, one releasable mounting system unit 100 is provided on the hull 12. In other examples two or more releasable mounting system unit 100 are provided on the hull 12. FIG. 1 shows the starboard side of a submarine, with units 100 of the releasable mounting system provided on the side of the main hull and a bridge fin 22. The port side (which is hidden in the figures, as the figures show only the starboard side) is also provided with units of the releasable mounting system 100 (for example in the same locations on the main hull and bridge fin 22 as on the starboard side).

The releasable mounting system 100 may be provided with units for carrying payload units at the aft casing deck, lateral sides of the hull and/or the keel.

The releasable mounting system 100 is operable to release (e.g. uncouple), the payload unit 202, 204 from the hull 12.

In one example, one payload unit 202, 204 is carried by the submarine external to the hull outer surface 20. In other examples two or more payload units 202, 204 are carried external to the hull outer surface 20. FIGS. 2 to 5 show the starboard side of a submarine configured to carry a payload 204. The port side is also configured to carry a payload 202.

Hence, as shown in FIGS. 2 to 5, the payload unit 202, 204 may comprise a port side payload unit 202. The location of this is indicated by a dotted line, where dotted lines from their respective reference numerals indicate the feature being indicated is on the port side of the hull 12. The releasable mounting system 100 may comprise a port side unit 110 located on the port side of the hull 12 for carrying and releasing the port side payload unit 202. The port side unit 110 may comprise a port side payload unit mounting apparatus 132. In the examples shown, six side units (e.g. pads) 110 are shown, each with a mounting apparatus 132.

The port side payload unit mounting apparatus 132 may be operable to have a first configuration in which the port side payload unit mounting apparatus 132 is engaged with (e.g. fixed to) the port side payload unit 202, and thus locate the port side payload unit 202 on the port side of the hull 12.

The port side payload unit mounting apparatus 132 may be operable to have a second configuration in which the port side payload unit mounting apparatus 132 is disengaged (e.g. uncoupled) from the port side payload unit 202, so that the port side payload unit 202 can be separated from the hull 12.

The port side payload unit mounting apparatus 132 may comprise a mounting bolt. In the first configuration the mounting bolt carries the port side payload unit 202. In the second configuration the mounting bolt is removed (i.e. undone) to releases the port side payload unit 202 from the hull 12.

The port side payload unit mounting apparatus 132 may comprise a port side explosive release unit 142. In the first configuration the port side explosive release unit 142 carries the port side payload unit 202. In the second configuration the port side explosive release unit 142 releases the port side payload unit 202 from the hull 12.

Additionally or alternatively, as shown in FIGS. 2 to 5, the payload unit 202, 204 may comprise a starboard side payload unit 204. The releasable mounting system 100 may comprise a starboard side unit 120 located on the starboard side of the hull 12 for carrying and releasing a starboard side payload unit 204. The starboard side unit 120 may comprise a starboard side payload unit mounting apparatus 134.

The starboard side payload unit mounting apparatus 134 may be operable to have a first configuration in which the starboard side payload unit mounting apparatus 134 is engaged with (e.g. fixed to) the starboard side payload unit 204, and thus locate the starboard side payload unit 204 on the starboard side of the hull 12.

The starboard side payload unit mounting apparatus 134 may be operable to have a second configuration in which the starboard side payload unit mounting apparatus 134 is disengaged (e.g. uncoupled) from the starboard side payload unit 204, so that the starboard side payload unit 204 can be separated from the hull 12.

The starboard side payload unit mounting apparatus 134 may comprise a mounting bolt. In the first configuration the mounting bolt carries the starboard side payload unit 204. In the second configuration the mounting bolt is removed (i.e. undone) to release the starboard side payload unit 204 from the hull 12.

The starboard side payload unit mounting apparatus 134 may comprise a starboard side explosive release unit 144. In the first configuration the starboard side explosive release unit 144 carries the starboard side payload unit 204. In the second configuration the starboard side explosive release unit 144 releases the starboard side payload unit 204 from the hull 12.

The port side payload unit mounting apparatus 132 may be operable to switch from the first configuration to the second configuration in response to a first command signal, for example generated by a user or a control system.

The starboard side payload unit mounting apparatus 134 may be operable to switch from the first configuration to the second configuration in response to a second command signal, for example generated by a user or a control system.

The first command signal and second command signal may be derived from a common command signal, for example generated by a user or a control system.

The port side payload unit mounting apparatus 132 and the starboard side payload unit mounting apparatus 134 may be independently operable to switch from the first configuration to the second configuration. That is to say, the port side payload unit mounting apparatus 132 may be operable to switch from the first configuration to the second configuration independently of the starboard side payload unit mounting apparatus 134 switching from the first configuration to the second configuration, and/or the starboard side payload unit mounting apparatus 134 may be operable to switch from the first configuration to the second configuration independently of the port side payload unit mounting apparatus 132 switching from the first configuration to the second configuration.

The port side explosive release unit 142 may comprise one or more explosive bolts (e.g. a pyrotechnic fastener). The starboard side explosive release unit 144 may comprise one or more explosive bolts (e.g. pyrotechnic fastener).

In examples in which a payload unit is mounted to a location other than the port or starboard side of the hull, it may be mounted and released using the same mount and release features and mechanisms as described with reference to the port and starboard mounted payload units.

The (or each) payload unit 202, 204 is configured to remain neutrally buoyant while coupled to the hull 12. The (or each) payload unit 202, 204 may be configured to remain neutrally buoyant during its operation of the payload unit.

Figure 2:
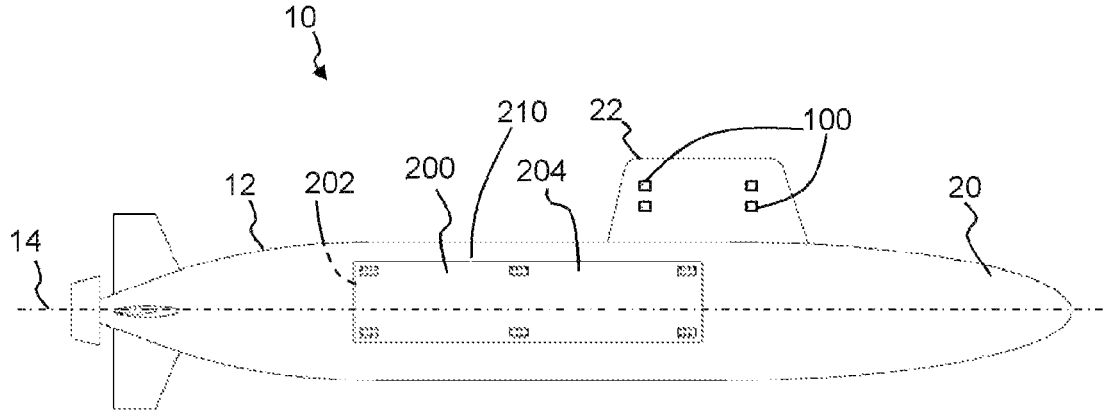
FIG. 2 shows a watercraft system comprising a submarine/submersible and payload according to the present disclosure.
Figure 4:
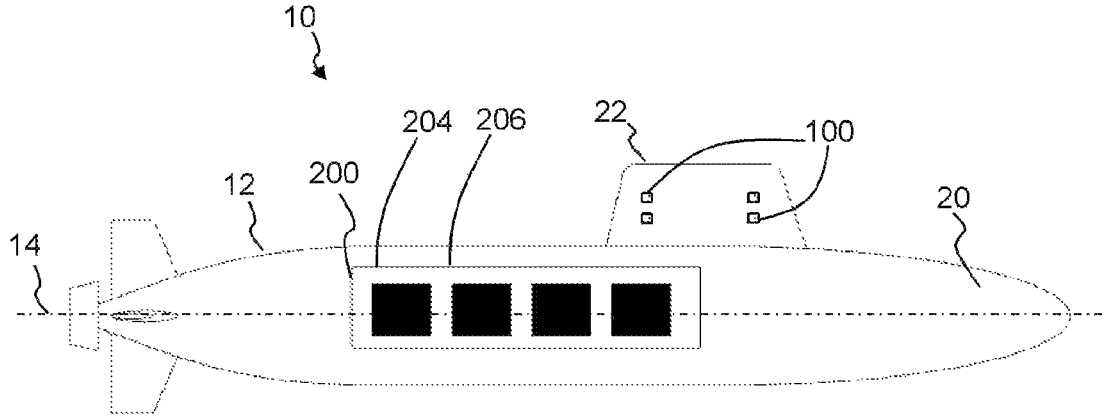
FIG. 4 shows an example in which the payload is a neutrally buoyant external battery.

In such examples, the payload unit 202, 204 may comprise at least one of a sensor system, a sonar system, a watercraft signature altering system, a sea-bed deployable system, for example as illustrated as a rectangular unit in FIG. 2. Alternatively, in such examples, the payload unit 202, 204 may comprise at least one of a rechargeable battery system 206, a 'single shot' disposable battery system 206, as shown in FIG. 4.

The payload unit 202, 204 may be configured and operable to carry a material which is removed from the payload unit 202, 204 during the operation of the payload unit 202, 204. The payload unit 202, 204 may be operable to receive a mass of water into the payload unit 202, 204 which equals the mass of material removed from the payload unit 202, 204.

In such an example, the payload unit 202, 204 may comprise at least one of a fuel tank 210, projectile storage and/or launch system 208, sea-bed deployable system.

Hence a payload unit 202, 204 can be used to implement a test environment for sonar and sensor systems that can be rapidly developed and evolved without necessitating a major refit. Additionally or alternatively the side module can be used to provide a removable underwater sensor system (e.g. sonar flank array), an extended range battery system, a 'single shot' disposable battery system, a surface to surface missile launch capability, a surface to air missile launch capability, an external torpedo carrying capability, a signature improvement capability, a sea-bed deployable payload.

Examples of the payload units 202, 204 may comprise regions (e.g. a chamber or chambers) with a buoyancy material, for example a foam (e.g. a syntactic foam) provided to generate an upwards force to counter the weight of the payload unit housing and the equipment and/or material it contains.

As set out above, the payload unit 202, 204 may be configured to carry a material which is removed from the payload unit 202, 204 during the operation of the payload unit 202, 204, for example a liquid fuel.

During operation, the payload unit 202, 204 may be actively controlled to be neutrally buoyant during operation of the payload unit 202, 204. Alternatively the payload unit 202, 204 may be configured to automatically to maintain a predefined mass.

The method of operation may comprise the step of controlling a flow of water into the payload unit 202, 204 so that the mass of water entering the payload unit equals the mass of material removed from the payload unit 202, 204.

Figure 3:
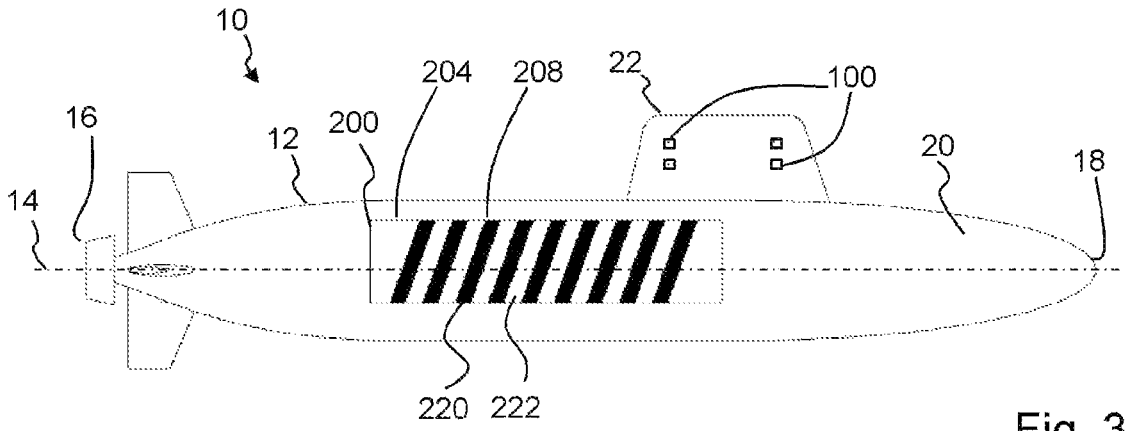
FIG. 3 shows an example in which the payload is shown in partial cross section showing storage chambers and chambers for buoyancy compensation.

In the example of FIG. 3 the payload unit 202, 204 comprises storage chambers 220 in which objects are stored until deployed. The payload unit 202, 204 further comprises floodable water tanks 222. When an object is removed from a storage chamber 220 in the payload unit, at least a proportion of one or more of the respective storage chamber 220 is flooded. If required, at least a proportion of one or more of the floodable water tanks 222 (which were empty/dry while the object was being stored) may also be flooded, so that the weight of water which has entered the payload unit is equal to the weight of the object which has left the payload unit.

Figure 5:
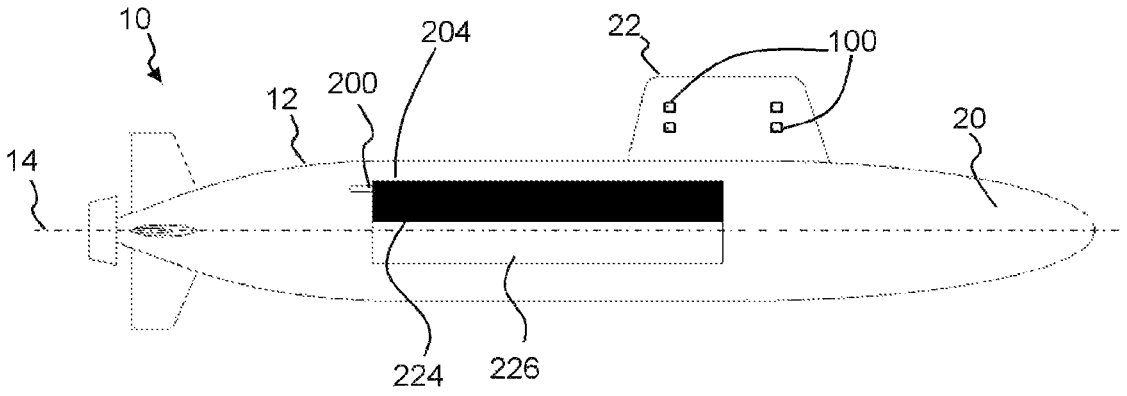
FIG. 5 shows an example in which the payload is a neutrally buoyant external diesel tank.

In the example of FIG. 5, the payload unit 202, 204 comprises a fuel tank 224 and a floodable water tank 226. During operation, weight of water taken into tank 226 is controlled to equal to weight of fuel transferred from tank 224. The control of this this may be via a flow meter on a fuel pipe and a proportional control valve combined with a flow meter on a water tank inlet such that weight of fuel (for example diesel) transferred from the tank is equal to weight of water transferred into the tank.

Hence there is provided a watercraft system 10 comprising a submarine with releasable mounting system 100 operable to carry or release a payload unit 202, 204 from the hull 12 of the submarine.

The releasable mounting system 100 is operable to uncouple the payload unit 202, 204 from the hull 12 when required, and to carry the payload for as long as needed. In particular the releasable mounting system provides for ease of mounting and detaching of the payload from the submarine.

Since the payload unit 202, 204 is neutrally buoyant, the presence or absence of the payload on the hull of the submarine does not impact its buoyancy, and hence does not require buoyancy systems of the submarine to compensate for the presence or absence of the payload unit 202, 204.

This enables the capacity of volumetric size of the watercraft system 10 to be adjusted.

This also enables equipment of the watercraft system 10 to moved, removed, replaced, fitted as required. This has significant maintenance advantages since it means that equipment or material in the payload unit 202, 204 which needs to be replenished, repaired, reconfigured, updated and/or fixed can be entirely removed from the watercraft system 10 so that it may be worked on more easily away from the submarine. This also means that a substitute payload unit 202, 204 can be installed in on the submarine hull 12 to get it operational as soon as possible rather than waiting for the former payload unit 202, 204 to be repaired.

Hence a watercraft system 10 may be quickly configured to meet the needs of a particular operational role or test by adapting the watercraft system 10 fit the desired range of equipment.

The payload units may be re-used. For example, after a first use, the payload units may be renewed, refueled, re-loaded etc, and attached to the same of a different submarine hull.

The payload units may jettisoned during operation of the submarine (for example by triggering the explosive bolts) to reduce the amount of fuel used by the submarine and/or to increase its speed and manoeuvrability.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A watercraft system comprising:

a submarine or a submersible configured to be submerged in water, having an external hull having a longitudinal axis which extends between an aft end and a forward end, the hull defining a hull outer surface;

a releasable mounting system located on a lateral side of the hull for carrying a payload unit external to the hull outer surface; and the payload unit, which is operable to remain neutrally buoyant while coupled to the hull;

wherein the releasable mounting system comprises a payload unit mounting apparatus having a mounting bolt and operable to have a first configuration in which the mounting bolt carries the payload unit on the hull, and a second configuration in which the mounting bolt is removed from the payload unit to decouple the payload unit from the hull;

wherein the payload unit is a storage chamber configured to carry a material which is removable from the storage chamber during the operation of the payload unit while coupled to the hull outer surface; and wherein the payload unit is operable to receive a mass of water into the storage chamber and/or a floodable water tank which equals the mass of material removed from the storage chamber while coupled to the hull outer surface.

2. The watercraft system of claim 1, wherein the payload unit comprises at least one of:

a sensor system;

a sonar system;

a rechargeable battery system;

a single-shot disposable battery system;

a watercraft signature altering system; or a sea-bed deployable system.

3. The watercraft system of claim 1, wherein the payload unit comprises at least one of:

a fuel tank;

projectile storage;

a launch system; or a sea-bed deployable system.

4. The watercraft system of claim 1, wherein:

the payload unit comprises a port side payload unit;

the releasable mounting system comprises a port side unit located on the port side of the hull for carrying and releasing the port side payload unit; and the port side unit comprises a port side payload unit mounting apparatus, and the port side payload unit mounting apparatus is operable to have a first configuration in which the port side payload unit mounting apparatus is engaged with the port side payload unit, and a second configuration in which the port side payload unit mounting apparatus is disengaged from the port side payload unit.

5. The watercraft system of claim 4, wherein the port side payload unit mounting apparatus is operable to switch from the first configuration to the second configuration in response to a command signal.

6. The watercraft system of claim 5, wherein:

the payload unit comprises a starboard side payload unit;

the releasable mounting system comprises a starboard side unit located on the starboard side of the hull for carrying and releasing a starboard side payload unit;

the starboard side unit comprises a starboard side payload unit mounting apparatus; and the starboard side payload unit mounting apparatus operable to have a first configuration in which the starboard side payload unit mounting apparatus is engaged with the starboard side payload unit, and a second configuration in which the starboard side payload unit mounting apparatus is disengaged from the starboard side payload unit.

7. The watercraft system of claim 6, wherein the command signal is a first command signal, and wherein the starboard side payload unit mounting apparatus is operable to switch from the first configuration to the second configuration in response to a second command signal.

8. The watercraft system of claim 7, wherein the first command signal and second command signal are derived from a common command signal.

9. The watercraft system of claim 8, wherein: the port side payload unit mounting apparatus and the starboard side payload unit mounting apparatus are independently operable to switch from the first configuration to the second configuration.

10. The watercraft system of claim 6, wherein the starboard side payload unit mounting apparatus comprises a starboard side explosive release unit, wherein:

in the first configuration the starboard side explosive release unit carries the starboard side payload unit; and in the second configuration the starboard side explosive release unit releases the starboard side payload unit from the hull.

11. The watercraft system of claim 5, wherein the port side payload unit mounting apparatus comprises a port side explosive release unit, wherein:

in the first configuration the port side explosive release unit carries the port side payload unit; and in the second configuration the port side explosive release unit releases the port side payload unit from the hull.

12. The watercraft system of claim 7, wherein the starboard side payload unit mounting apparatus comprises a starboard side explosive release unit, wherein:

in the first configuration the starboard side explosive release unit carries the starboard side payload unit; and in the second configuration the starboard side explosive release unit releases the starboard side payload unit from the hull.

13. The watercraft system of claim 4, wherein the port side payload unit mounting apparatus comprises a port side explosive release unit, wherein:

in the first configuration the port side explosive release unit carries the port side payload unit; and in the second configuration the port side explosive release unit releases the port side payload unit from the hull.

14. The watercraft system of claim 1, wherein:

the payload unit comprises a starboard side payload unit;

the releasable mounting system comprises a starboard side unit located on the starboard side of the hull for carrying and releasing a starboard side payload unit;

the starboard side unit comprises a starboard side payload unit mounting apparatus; and the starboard side payload unit mounting apparatus operable to have a first configuration in which the starboard side payload unit mounting apparatus is engaged with the starboard side payload unit, and a second configuration in which the starboard side payload unit mounting apparatus is disengaged from the starboard side payload unit.

15. The watercraft system of claim 14, wherein the starboard side payload unit mounting apparatus is operable to switch from the first configuration to the second configuration in response to a command signal.

16. The watercraft system of claim 1, wherein:

the payload unit comprises a port side payload unit and a starboard side payload unit;

the releasable mounting system comprises a port side unit located on the port side of the hull for carrying and releasing the port side payload unit;

the port side unit comprises a port side payload unit mounting apparatus;

the releasable mounting system comprises a starboard side unit located on the starboard side of the hull for carrying and releasing a starboard side payload unit; and the starboard side unit comprises a starboard side payload unit mounting apparatus;

wherein the port side payload unit mounting apparatus is operable to switch from a first configuration to a second configuration in response to a first command signal; and wherein the starboard side payload unit mounting apparatus is operable to switch from a first configuration to a second configuration in response to a second command signal; and wherein the first command signal and second command signal are derived from a common command signal.

17. A method of operation of a watercraft system, wherein the watercraft system includes a submarine or a submersible configured to be submerged in water, having an external hull having a longitudinal axis which extends between an aft end and a forward end, the hull defining a hull outer surface;

a releasable mounting system located on a lateral side of the hull for carrying a payload unit external to the hull outer surface; and the payload unit, which is operable to remain neutrally buoyant while coupled to the hull;

wherein the releasable mounting system comprises a payload unit mounting apparatus having a mounting bolt and operable to have a first configuration in which the mounting bolt carries the payload unit on the hull, and a second configuration in which the mounting bolt is removed from the payload unit to decouple the payload unit from the hull;

wherein the payload unit is a storage chamber configured to carry a material which is removable from the storage chamber during the operation of the payload unit while coupled to the hull outer surface; and wherein the payload unit is operable to receive a mass of water into the storage chamber and/or a floodable water tank which equals the mass of material removed from the storage chamber while coupled to the hull outer surface, the method comprising:

controlling the payload unit to be neutrally buoyant during operation of the payload unit.

18. The method of claim 17, further comprising:

controlling a flow of water into the storage chamber and/or a floodable water tank so that the mass of water entering the payload unit equals the mass of material removed from the payload unit.

* * * * *